United States Patent [19]

Zeuner et al.

[11] Patent Number: 4,589,437

[45] Date of Patent: May 20, 1986

[54] REEL SPEED VALVE ASSEMBLY

[76] Inventors: Kenneth W. Zeuner, 43 Red Fox Dr., New Hope, Pa. 18938; Steven K. Zeuner, 39 Larch Cir.; Thomas A. Zeuner, 230 Woodlake Dr., both of Holland, Pa. 18966

[21] Appl. No.: 568,582

[22] Filed: Jan. 6, 1984

Related U.S. Application Data

[63] Continuation-in-part of Ser. No. 511,576, Jul. 7, 1983, abandoned.

[51] Int. Cl.[4] ..... F15B 13/043

[52] U.S. Cl. ..... 137/117; 137/596.13; 137/625.63; 137/625.64

[58] Field of Search ..... 137/117, 625.63, 625.64, 137/596.13

[56] References Cited

U.S. PATENT DOCUMENTS

| | | | |
|---|---|---|---|
| Re. 26,338 | 1/1968 | Allen | 137/117 |
| 2,600,348 | 6/1952 | Walthers | 137/625.63 X |
| 3,381,936 | 5/1968 | Allen | 137/117 X |
| 3,532,104 | 10/1970 | Hoen | 137/117 X |
| 3,596,677 | 8/1971 | Clark | 137/501 |
| 3,628,557 | 12/1971 | Newborough | 137/117 X |
| 3,785,392 | 1/1974 | Baker | 137/117 |
| 4,121,610 | 10/1978 | Harms et al. | 137/117 |
| 4,430,846 | 2/1984 | Presley et al. | 137/117 X |
| 4,462,566 | 7/1984 | French | 251/30 |

FOREIGN PATENT DOCUMENTS

| | | | |
|---|---|---|---|
| 2445053 | 4/1976 | Fed. Rep. of Germany | 137/625.64 |
| 2506864 | 8/1976 | Fed. Rep. of Germany | 137/625.64 |

*Primary Examiner*—Gerald A. Michalsky
*Attorney, Agent, or Firm*—Ratner & Prestia

[57] ABSTRACT

A reel speed valve assembly for controlling the speed of a combine reel including a double acting compensator valve, a proportional controller valve, a relief valve, a load sense valve, and a manually adjustable controller valve may be operated as either a closed or open center valve and may be located at any position in a stack with minimal adjustment to manufacturing procedures.

8 Claims, 17 Drawing Figures

REEL SPEED VALVE ASSEMBLY

This application is a continuation-in-part of application Ser. No. 511,576, filed July 7, 1983, now abandoned.

BACKGROUND OF THE INVENTION

A. Field of the Invention

This invention is in the field of control valve assemblies for regulating the speed of harvester or combine reels.

B. Background Art

Compensated valves for the control of farm equipment machinery are well known in the prior art. In particular, proportional pressure compensated valves for the control of combine reel speed are generally known. Such valves are typically of either the open or closed center type and are also typically manufactured for a particular mounting configuration (discreet, top of stack, middle of stack, bottom of stack).

Further, such reel speed control valves typically contain relief valves, manual control valves, and/or pressure or load sense valve assemblies.

A valve for regulating hydraulic flow to a combine reel motor is taught in U.S. Pat. No. 3,979,908 to Alderson. This spool-type valve directs a priority flow to the reel motors of a combine while providing flow to a secondary load if possible. The priority flow valve of this patent is useable in either an open-center or closed-center system.

Yet another example of a hydraulic control valve incorporating compensators is described in U.S. Pat. No. 3,827,453 to Malmott et al. This valve comprises a plurality of conventional spool-type valves and a conventional compensator which regulates the pressure differential across the spool valve metering orifice and diverts excess flow to a reservoir when necessary. Also illustrated is the use of a relief check valve for diverting excessive pressures to the reservoir.

SUMMARY OF THE INVENTION

A. Object of the Invention

Notwithstanding the above background art, there remains a need for an efficient, versatile, and compact reel speed valve assembly.

It is therefore a primary objective of the present invention to provide a reel speed valve assembly adaptable to a maximal number of differing configurations with minimum change in manufacturing procedures.

Yet another object of the present invention is to provide a reel speed valve assembly which is controlled by a digital stepper motor or similar proportional drive.

Still another object of the present invention is to provide a reel speed valve assembly which is capable of functioning in either an open or closed center mode.

B. Brief Description

The reel speed valve assembly of the present invention incorporates within a single housing, a double acting compensator valve, a manually adjustable controller valve, a proportional controller valve, a relief check valve and a pressure or load sense valve. The proportional control valve may be of the "spool within a spool" servo-follower proportional valve type.

Manual control valves, relief check valves, and pressure or load sense valves, are optional and may be included within the unitary housing if desired.

In operation, the reel speed valve assembly of the present invention provides proportional controller flow which is compensated to allow constant flow volume under varying conditions of pressure and flow.

DETAILED DESCRIPTION OF THE CONTROL VALVE

Figure 1:
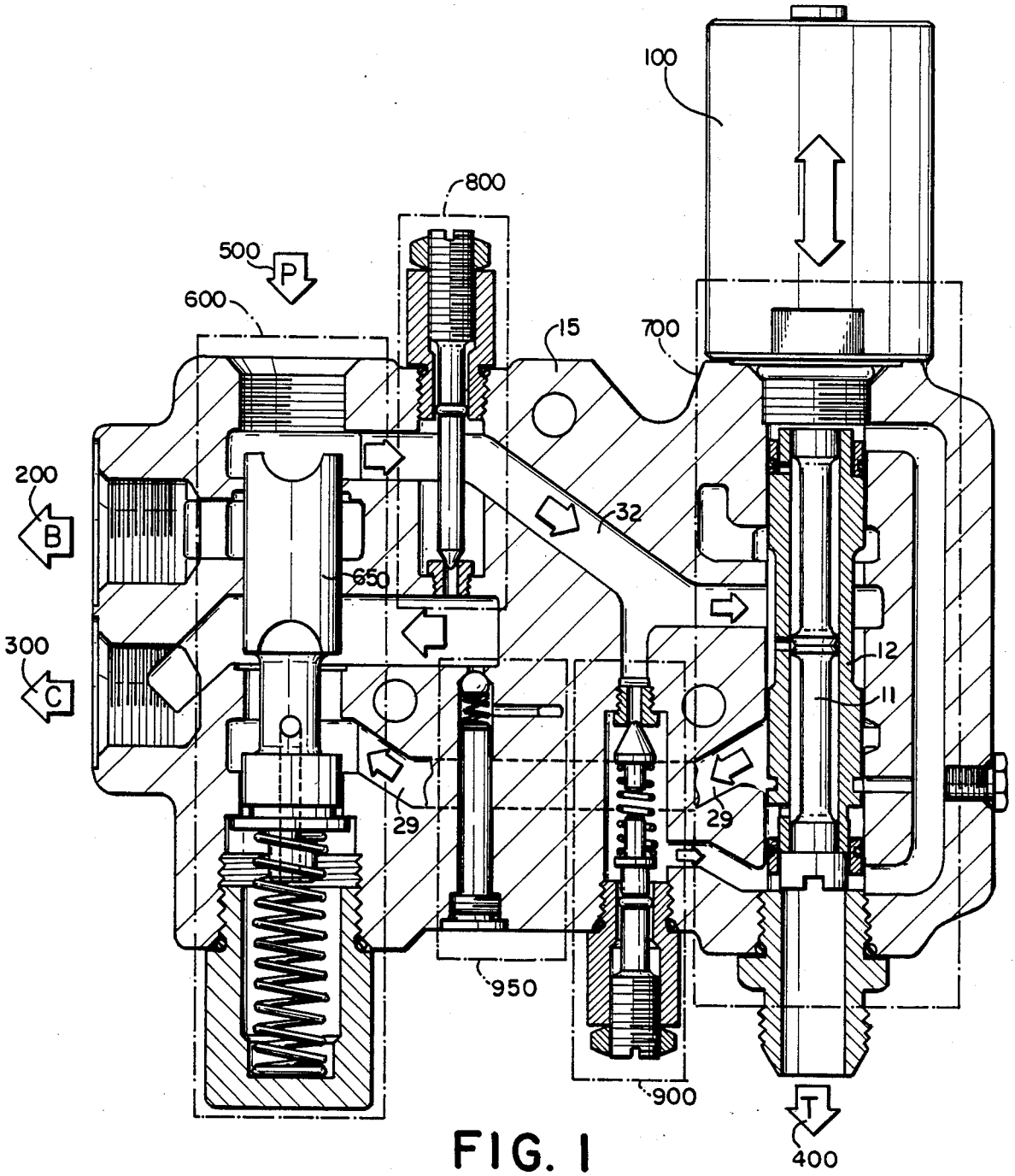
FIG. 1 shows a cross-section of the reel speed valve assembly of the present invention.

Referring now to FIG. 1 there is shown a reel speed valve assembly comprising a compensator valve 600, a control valve 700, a manual bypass valve 800, a relief valve 900, and an output pressure (load) sense ball check valve 950. A source of hydraulic pressure such as a pump (not shown) is connected to the reel speed valve assembly at pressure inlet port 500. Low pressure return flow to a tank (not shown) exits the valve assembly at outlet port 400. Controlled flow exits the valve assembly via outlet port 300, while bypass flow exits via outlet port 200.

Figure 2:
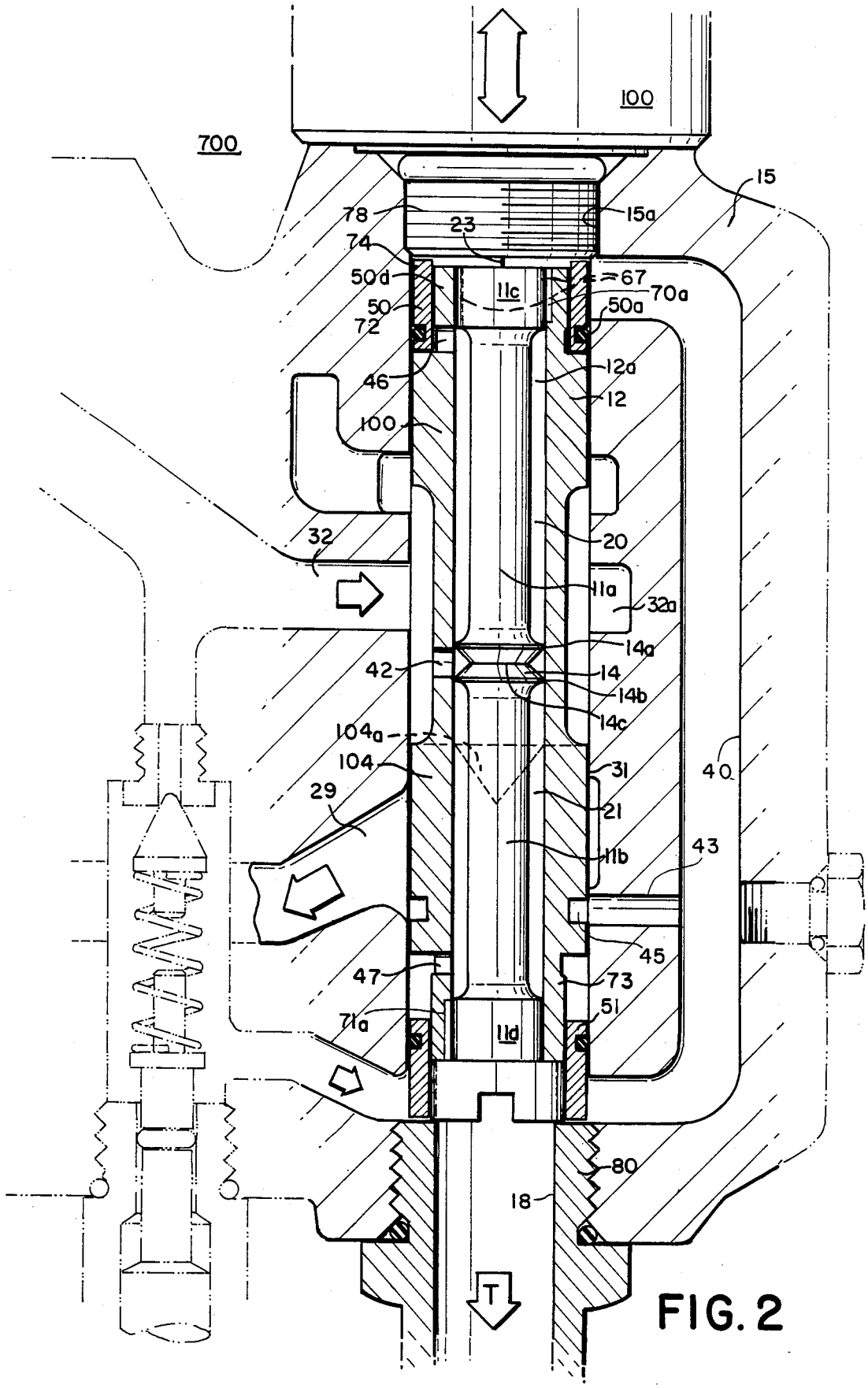
FIG. 2 is a cross-section of the proportional controller valve of the present invention.
Figure 2A:
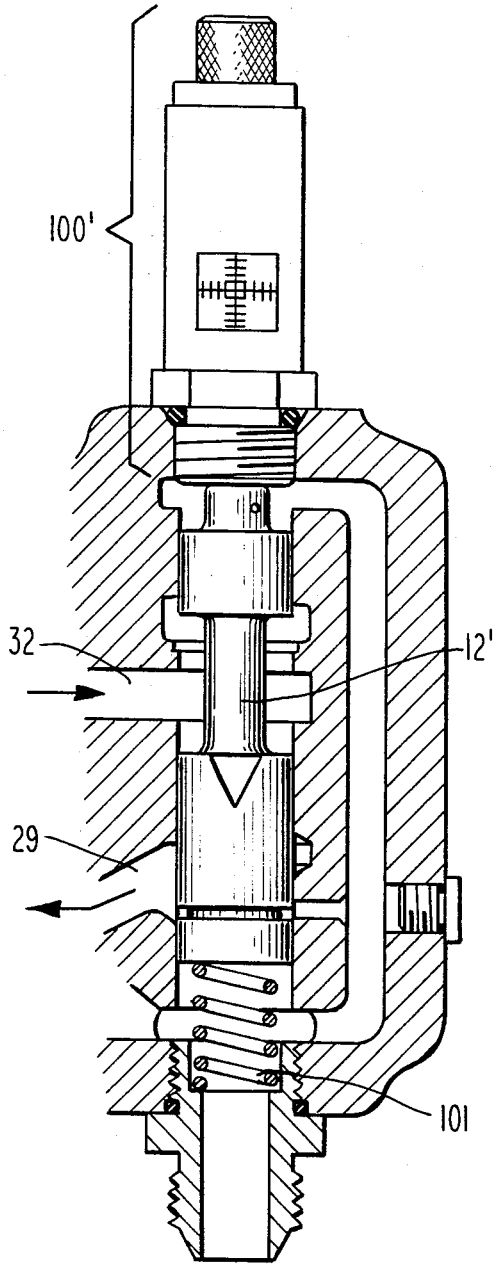
FIG. 2*a* shows an alternate linear actuator for the proportional controller valve of the present invention
Figure 2B:
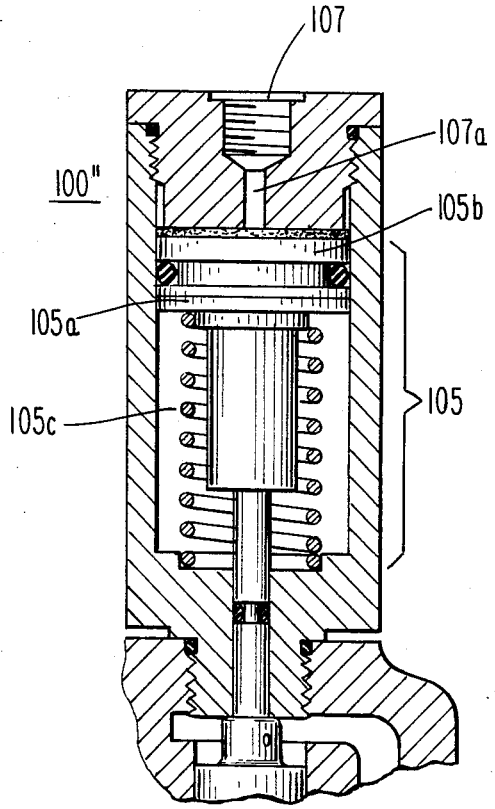
FIG. 2*b* shows another alternate linear actuator for the proporrional controller valve of the present invention.
Figure 2C:
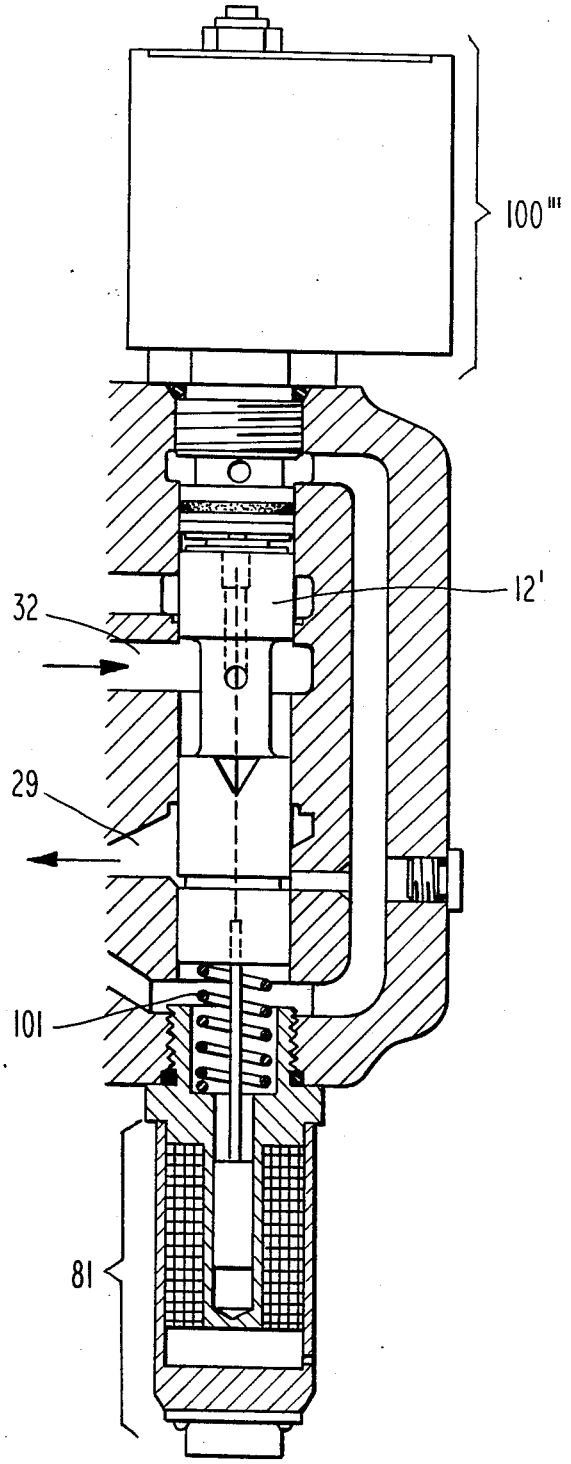
FIG. 2*c* shows yet another linear actuator for the proportional controller valve of the present invention using a normally-open pilot valve.

Focusing more closely on control valve 700, shown in more detail in FIG. 2, there is shown a servo-follower proportional control spool valve generally described in parent application Ser. No. 511,576, now abandoned, which compprises a housing 15 having a cylindrical bore 15*a* for receiving a main spool 12. The main spool has an open bore 12*a* for slidably receiving a pilot spool 11. Valve 700 is coupled to a source of hydraulic pressure (not shown) via inlet passage 32.

Main spool 12 has upper cylindrical land 100 and lower cylindrical land 104 spaced axially with respect to the longitudinal axis of main spool 12. A transverse inlet metering orifice 42 extends between cylindrical bore 15*a* and bore 12*a* in the main spool 12. Upper land 100 extends into a reduced diameter cylindrical section 72 which defines the top end of main spool 12 while lower land 104 extends into reduced diameter cylindrical section 73 which defines the bottom end of main spool 12. Connecting passages 46 and 47 are formed transverse of the longitudinal axis of main spool 12 and provide connecting passages between bore 12*a* and chambers formed by the outer surfaces of sections 46 and 47 respectively.

Lands 100 and 104 on main spool 12 are slidably but sealingly received in cylindrical bore 15*a*. This bore presents a cylindrical land surface 31 disposed between annular recesses 32*a* and passage 47. Land 104 has metering V-groove 104*a* formed thereon At its top end, bore 15*a* forms an elongated end recess 74 for receiving land 67 and a floating annular spacer 50 which abuts an end wall of end cap 78. Spacer 50 has its inner cylindrically-shaped bore surface 50*d* ground to receive the outer surface of section 72. A slot is formed on the outer surface of spacer 50 to provide for an O-ring 50*a* for sealing engagement between the spacer and recess 74. It is in this manner that spacer 50 is effective to "float" within recess 74 and the recess is referenced to tank by way of a return passage 40 and tank port 18.

In a manner similar to the top end, a floating ring 51 is disposed about land 68 of pilot spool 11. It will be understood that these lower end components are substantially identical to analogous structures of the upper end components and need not be described in similar detail.

A groove 45 is formed on land 104 and communicates with outlet port 29 and a passage 43 with mian spool 12 in its illustrated full up or valve closed position. Passage 43 extends to return passage 40 so that with spool 12 in its valve closed state, outlet port 29 is in communication with tank port 18.

As previously described, pilot spool 11 is received within bore 12*a* of spool 12. Spool 11 has at its center a V-groove piston 14 defined by a pair of metering lands 14*a* and 14*b*, where the v-groove 14*c* is formed between the lands. In the null position of spool 11 with respect to spool 12 as shown in FIG. 1, V-shaped groove 14*c* is in communication with metering orifice 42. Metering lands 14*a* and 14*b* each form a sharp metering edge with a respective wall of orifice 42 and sealingly engage bore 12*a* so that there is no flow of fluid from orifice 42 into the left or right side of bore 12*a*. Spool 11 also has two axially spaced cylindrical lands 11*c* and 11*d* formed at the upper and lower ends of the spool to sealingly engage the upper and lower ends of open bore 12*a* in all positions of spool 11. Metering land 14*a* and land 11*c* are integrally interconnected by stem portion 11*a* which defines an elongated longitudinally directed annulus forming a longitudinal passage which extends almost one-half of the length of spool 11. Similarly, stem portion 11*b* interconnects a metering land 14*b* and land 11*d* with an elongated longitudinal annulus forming a passage extending almost half the length of spool 11. Passage 11*a* leads through to passage 46 and to bleed groove 70*a* formed on the inner surface of bore 12*a*, while passage 11*b* leads through to bleed groove 71*a* also formed on the inner surface of bore 12*a*, and to passage 47. To provide axial movement of pilot spool 11, there is provided an actuator 23 which is rigidly connected as shown through the center of top portion 11*c* to the top section of spool 11. Actuator 23 extends through chamber 74 and through the axis of end stop 78 in sealing relation thereto.

In operation, in the position shown in FIG. 2, spools 11 and 12 are in their center position within bore 15*a* and the spools are in their null position with respect to each other. In this position, main spool 12 is at a valve closed position in bore 15*a* with land 104 sealingly engaging the radius of bore 15*a*. Accordingly, in this neutral position of main spool 12 in bore 15*a*, there is no flow of fluid from the inlet passage 32 to outlet passage 29. With spools 11 and 12 at null there is no flow of fluid from passage 32 through metering orifice 42 to either of chambers 20 or 21.

Bleed grooves 70*a* and 71*a*, formed on the inner surfaces of bore 12*a* provide a path for fluid flow between passages 20 and 21 and tank. These bleed grooves are alternately opened and closed by motion of inner spool end portions 11*c* and 11*d*.

When inner spool 11 moves from its illustrated null position, the bleed grooves on the end of spool 11 toward which movement occurs are exposed to ambient pressure within bore 12*a*. This action permits bleed of this pressure to tank port 18, thus permitting more rapid frequency response of the valve assembly. When inner spool 11 is moved downwardly, spool 12 follows thereby (1) allowing flow from inlet passage 32 to outlet passage 29 and (2) stoppoing flow from passage 29 through passage 43 to tank.

DETAILED DESCRIPTION OF THE COMPENSATOR

Figure 3:
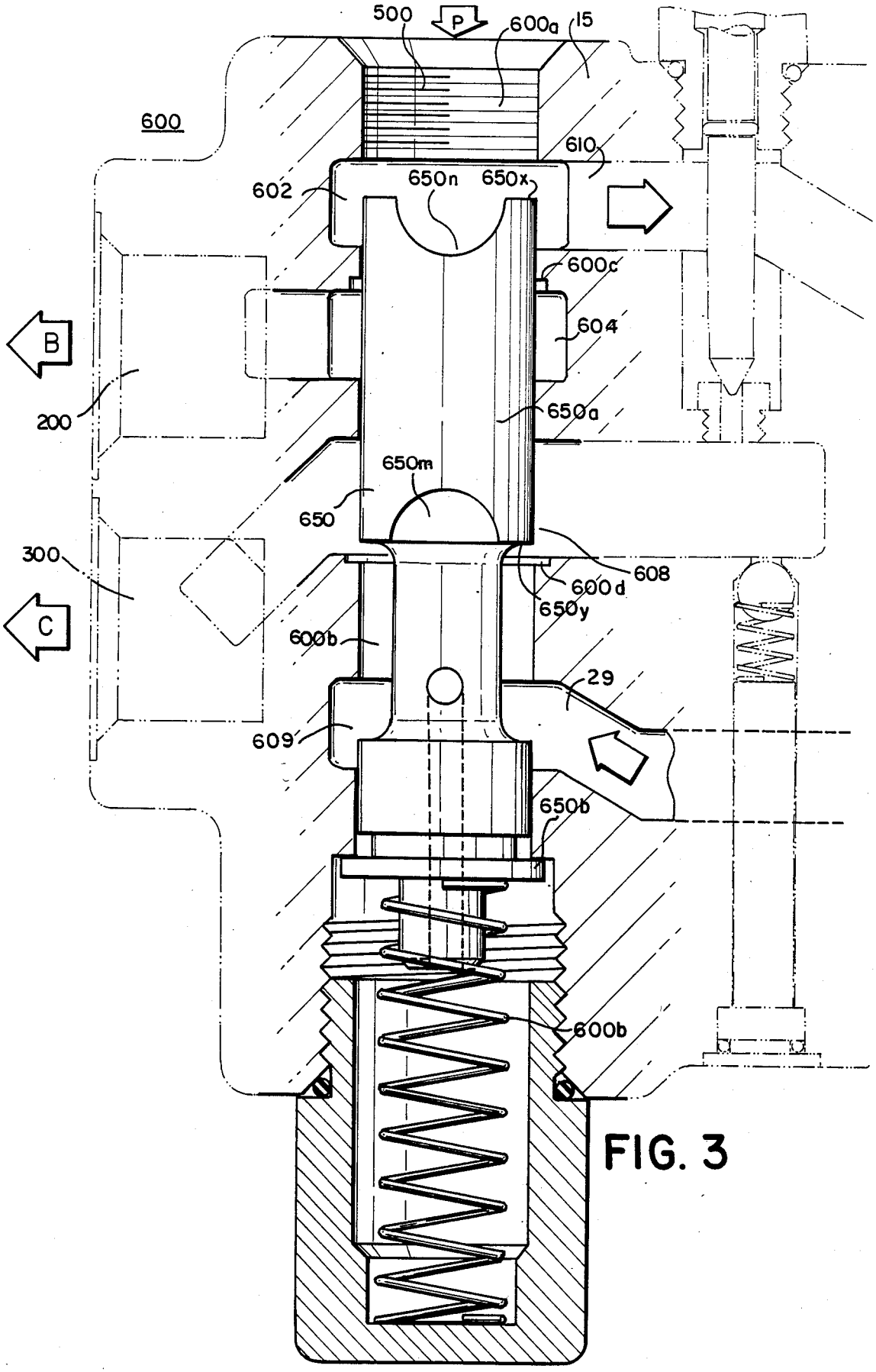
FIG. 3 is a cross-section of the double acting compensator valve of the present invention.

As shown in detail in FIG. 3, compensator valve 600 is comprised of housing 15 having cylindrical bore 600*a* having four annular recesses 602, 604, 608 and 609. Annular recesses 602, 604, 608 and 609 are in communication with respective ports 29, 610, 620 and 630. A source of hydraulic pressure such as a pump (not shown) is connected to inlet port 500.

Located within cylindrical bore 600*a* is compensator spool 650 having at its upper end, metering land 650*a* and at its lower end, cylindrical stop 650*b*. Spool 650 is biased into an upward position by biasing spring 600*b*. Land 650*a* has U-grooves 650*n* and 650*m* on metering edges 650*x* and 650*y* respectively, for metering flow against metering grooves 600*c* and 600*d* respectively.

Cylindrical bore 600*a* is further comprised of metering grooves 600*c* and 600*d*. Metering groove 600*c* coacts with metering edge 650*x* of cylindrical land 650*a* and U-groove 650*n* to meter fluid flow from inlet port 500 to bypass port 200. Metering groove 600*d* coacts with metering edge 650*y* of cylindrical land 650*a* and U-groove 650*m* to meter flow from passage 29 to controlled flow port 300.

In operation, pressure at inlet port 500 acts on the top of spool 650 to compress biasing spring 600*b*. Hydraulic fluid then flows out of compensator 600 via outlet port 610. Controlled flow of hydraulic fluid from control valve 700 enters compensator 600 at passage 29 and flows therefrom into annular recess 609. Pressure in annular recess 608 and bore 600*b* acts against metering edge 650*y* at the bottom of land 650*a* to urge spool 650 upward.

The ahove detailed opposed actions of pressure flow from port 500 and controlled flow in recess 608 serve to provide a constant volume controlled flow. Variations in flow volume are metered by movement of spool 650 so as to flow across U-groove 650*n* and exit from the compensator via bypass port 200.

DETAILED DESCRIPTION OF THE MANUAL BYPASS

Figure 4:
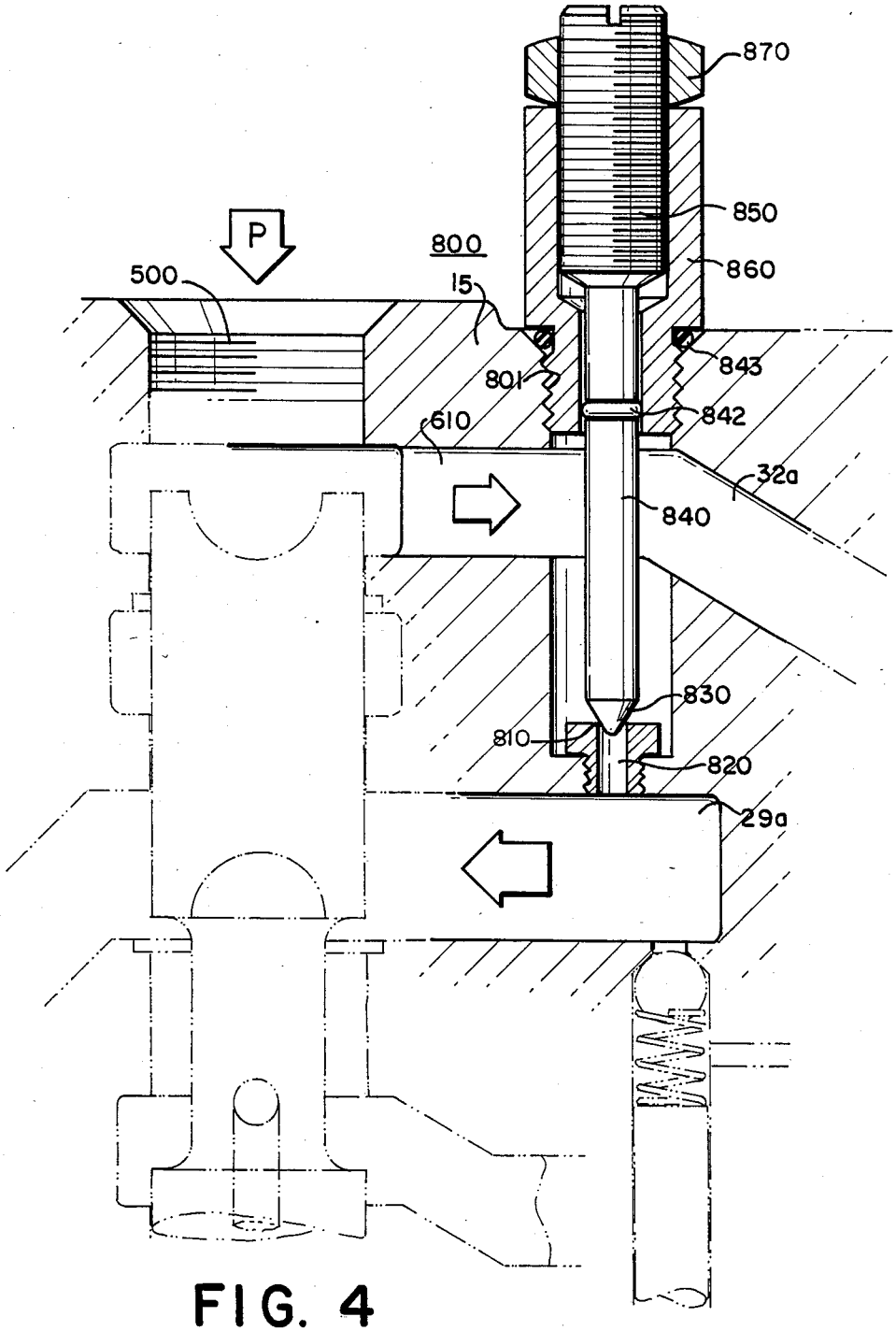
FIG. 4 is a cross-section of the manual bypass valve of the present invention.

Manual bypass valve 800 shown in FIG. 4, is comprised of a housing 15 having a bore 801 with an inlet port 610, outlet port 32*a*, and controlled flow port 820. A source of hydraulic pressure connected to compensator port 500 and exiting compensator 600 via port 610 flows through bore 801 and exits bore 801 via line 32*a*. Additionally, a portion of this flow may be directed into line 820 by opening bypass valve 800.

Bypass valve 800 is comprised of valve seat 810 formed at the lower end of bore 801, valve body 860 mounted within bore 801 and protruding therefrom, lock nut 870, valve stem 840, set screw 850, and valve plug 830. Valve plug 830 is adapted to engage valve seat 810 in sealing relationship. Valve 800 may be adjusted to regulate fluid flow from bore 801 into line 820 by adjustment of lead screw 850. Upward adjustment of lead screw 850 causes concomitant upward motion of valve stem 840, and permits fluid flow into line 820.

It will be understood that the valve function of bypass valve 800 may be accomplished by any suitable known valve device.

DETAILED DESCRIPTION OF THE RELIEF VALVE

Figure 5:
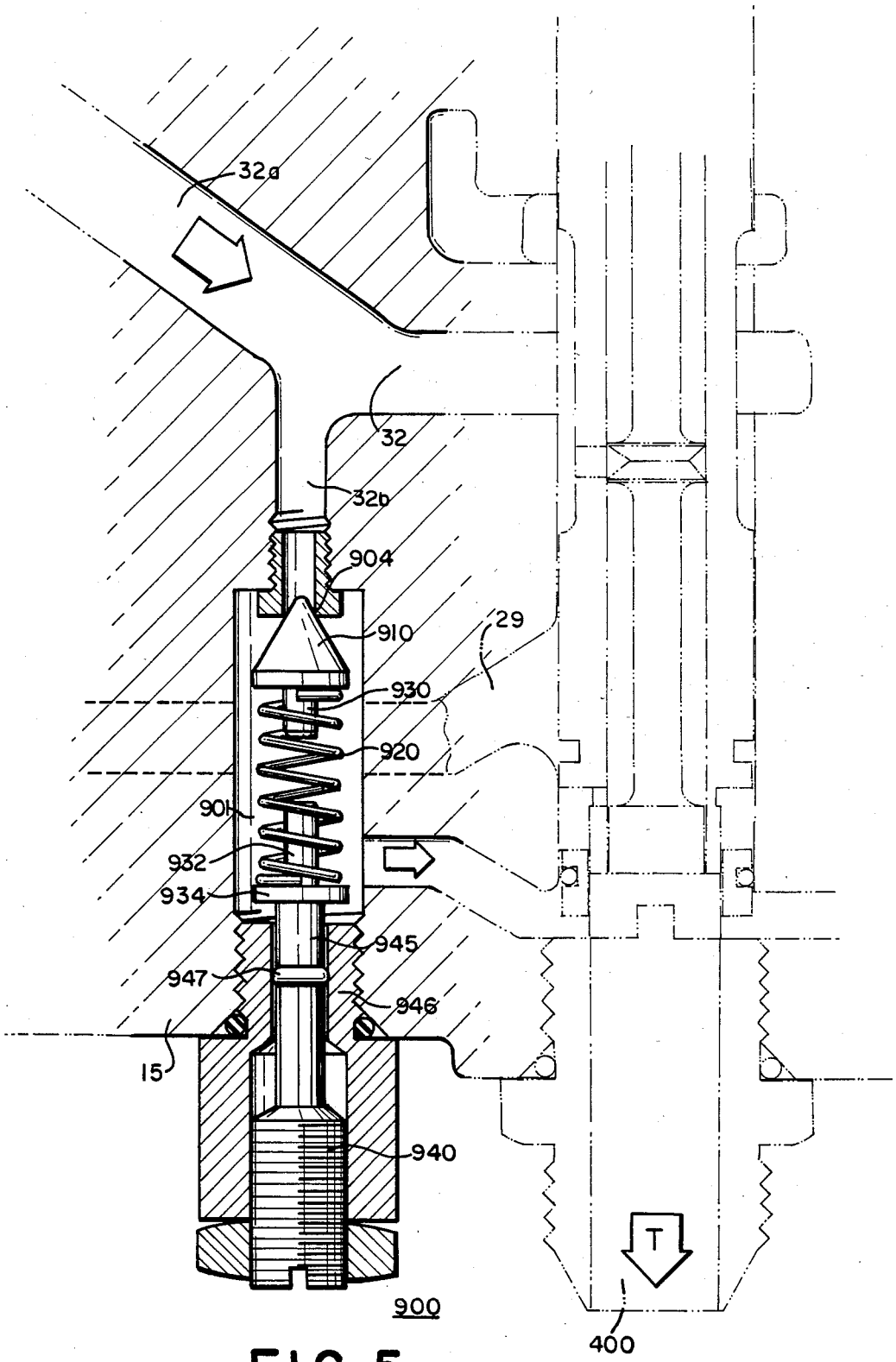
FIG. 5 is a cross-section of the relief check valve of the present invention.

Reflief valve 900 shown in FIG. 5, provides a path for diverting excessive pressure to tank. The relief valve is comprised of housing 15 having a bore 901. Bore 901 communicates at its upper end with channel **32*b* which in turn communicates at its upper end with channel 32*a*. Formed at the junction of channel 32*b* and bore 901 is valve seat 904**.

Relief valve 900 is preferably of the check valve type. Situated within bore 901 are valve plug 910 having on its lower end plug stem 930, biasing spring 920 for biasing valve plug 910 into sealing relationship against valve seat 904, and adjustable stop 934 having on its upper surface stop stem 932. Biasing spring 920 is positioned in surrounding relationship to plug stem 930 at its upper end and to stop stem 932 at its lower end.

Adjustable stop 934 is connected at its lower surface to adjustment stem 945 which is slidably retained within collar 946 and sealed by O-ring 947. Stem 945 is moved along its longitudinal axis by adjustment of adjusting screw 940.

In operation, adjustment of adjusting screw 940 effects an essentially linear adjustment of the pressure at which check valve 900 will open to permit flow therethrough.

DETAILED DESCRIPTION OF THE PRESSURE/LOAD SENSE

Figure 6:
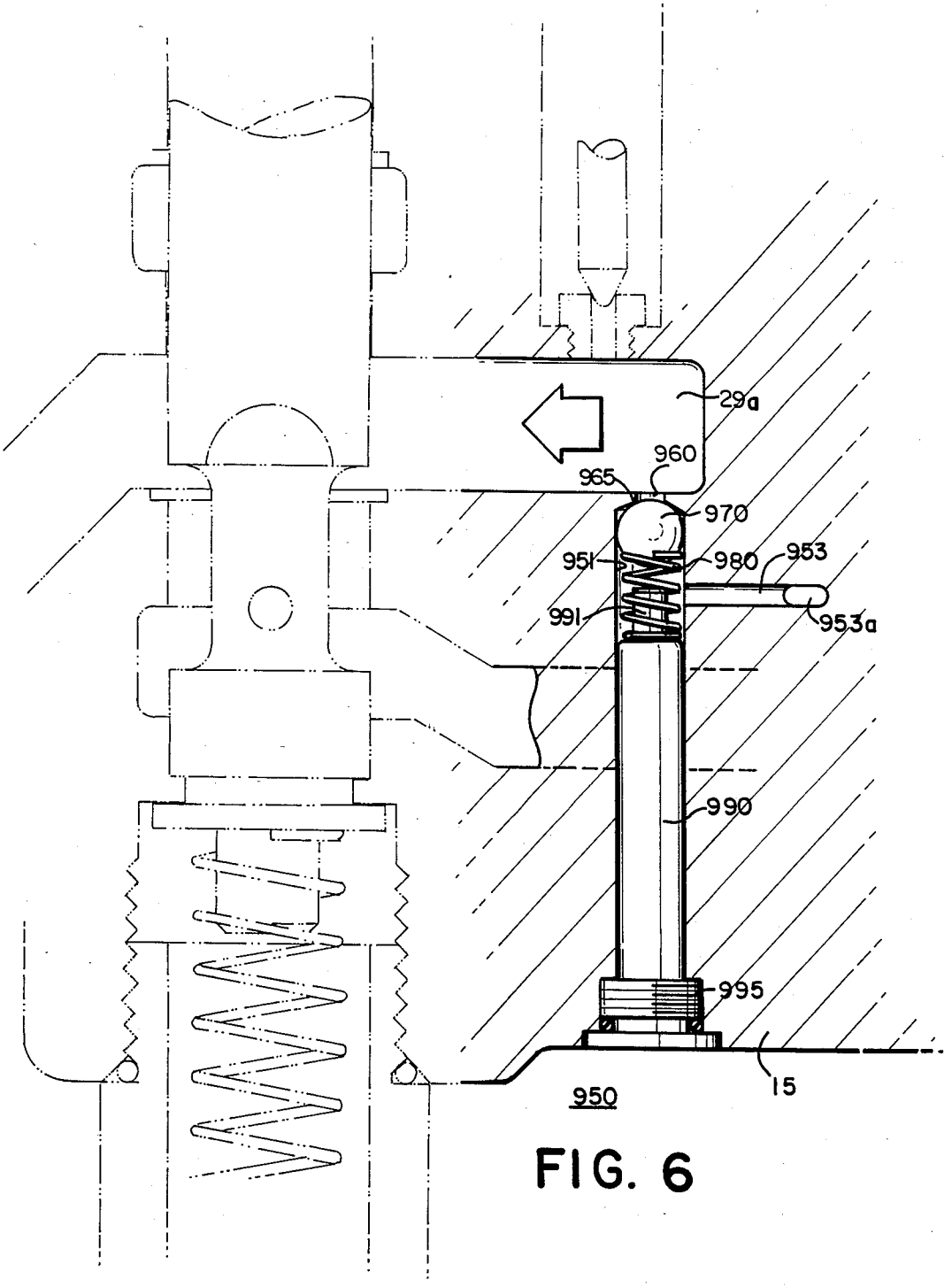
FIG. 6 is a cross-section of the pressure or load sense valve of the present invention.

Pressure sense valve 950 shown in FIG. 6, is comprised of housing 15 having bore 951 which communicates at its upper end with channel 960 which in turn is in communication with channel **29*a*. Located within bore 951 are ball stop 990, biasing spring 980, and ball 970. Valve seat 965 is formed at the junction of bore 951 and channel 960**.

Ball stop 990 has at its upper end a reduced diameter stem 991. Ball stop 990 further has at its lower end, retaining plug 995.

In operation, biasing spring 980 biases ball 970 into sealing relationship with valve seat 965 to prevent reverse flow into bore 960 from 953. Biasing spring 980 is situated in surrounding relationship to stem 992 and bears against the upper surface of ball stop 990. Bore 951 is in communication with channel 953 which terminates at port **953*a*** which may be connected to suitable pressure or flow monitoring means, or a load sense pump.

Alternative embodiments of the valve assembly of the present invention use a solid spool control valve instead of the previously described servofollower control valve 700. In these embodiments, a spool having the same external configuration as previously described and shown in FIGS. 1 and 2 is controlled by linear actuators other than a digital motor.

A first alternative embodiment as shown in FIG. **2*a*, uses a manually adjustable lead-screw 100' to position the control valve spool 12' and thus set the controlled flow rate. In this embodiment, spool 12' is biased into an upward, valve-closed position by a coil spring 101** located at the lower end of the spool.

FIG. **2*b* depicts yet another linear actuator for use within the valve assembly of the present invention. Actuator 100" comprises a small cylinder and piston assembly 105. This assembly may be actuated by a source of fluid pressure applied to port 107**.

Assembly 105 is comprised of bore **105*c* within which is mounted piston 105*a*. The upper face of piston 105*a* is exposed within chamber 105*b* and is acted on by fluid pressure therein. Chamber 105*b* is fed by orifice 107*a* which in turn communicates with port 107**.

Yet another linear actuator which may be employed for the purposes of the present invention is a proportional solenoid or normally-open pilot as shown in FIG. **2*c***. When such an actuator is used, a feedback transducer such as a linear variable displacement transformer or other transducer as, for instance, the Licon Series 33 of Ceramic Magnetics, Inc. may also be used to sense spool position and thus permit more precise adjustments in flow rate.

DESCRIPTION OF THE FLUID FLOW PATH

The valve assembly of the present invention is supplied a source of hydraulic flow by connection to a pump (not shown) at pressure inlet port 500. The primary fluid path through the valve assembly for controlled flow, enters the assembly at port 500 and exits the compensator assembly via line 610. Line 610 connects to inlet passage 32 of the controller valve 700 which allows flow through annular recess **32*a* to outlet passage 29. Outlet passage 29 traverses the valve assembly and communicates with annular recess 609 of compensator 600. Annular recess 609 in turn communicates with bore 600*a* and in turn with annular recess 608 and controlled flow port 300 which exits the valve assembly. An alternative controlled flow path diverges from the path just described at the junction of bore 801 with passage 610. Flow enters bore 801 which further communicates with bore 820. Bore 820 is also in communication with channel 29 which is in turn in communication with annular recess 608 of compensator 600 and outlet port 300**.

Bypass flows are metered by compensator spool 650 at its metering edge **650*x* and U-groove 650*n* and allowed to flow across metering edge 600*c* to annular recess 604. Annular recess 604 is in communication with bypass flow port 200** which exits the valve assembly.

Low pressure returns to tank which exits the valve assembly at tank port 400 originate both at controller bleed orifices 46 and 47, and at relief check valve assembly 900.

DESCRIPTION OF THE BLOCK DIAGRAMS

Referring now to FIGS. 7 through 14, there are shown block diagrams of the present invention which describe the paths available for fluid flow and positions of the flow controlling elements.

Figure 7:
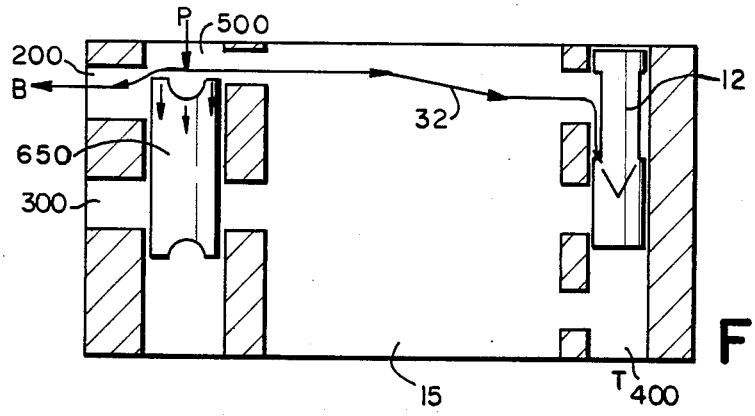
FIGS. 7 through 14 are block schematic diagrams of the operational modes of the reel speed valve assembly of the present invention.

Referring now to FIG. 7, the flow through the valve assembly of the present invention is shown when the controller spool 12 entirely prevents flow through the controller valve 700. With the controller spool 650 closed, pressure is exerted on the compensator spool in a downward direction permitting the entire flow to exit the valve assembly via the bypass port 200.

Figure 8:
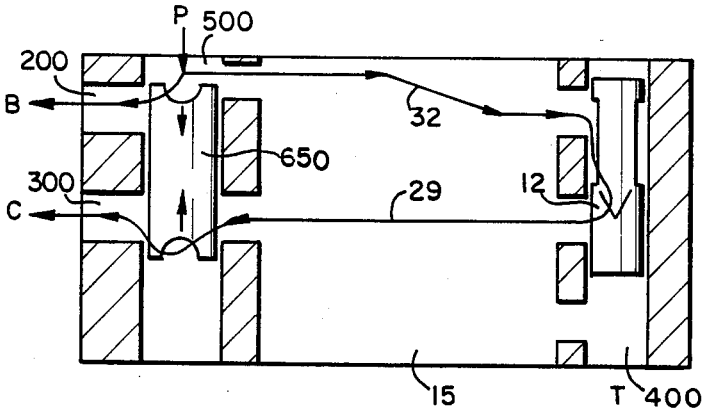

FIG. 8 details the operation of the valve assembly when the controller spool 62 allows fluid flow across the metering V-groove control orifice on its lower land. The metered control flow acts against the lower metering edge of the compensator spool 650 forcing it upward in opposition to the force exerted by the incoming flow from the pressure source 500. In this mode, the compensator acts to maintain constant pressure differential across the controller spool control orifice.

An increase in pressure or in flow rate is compensated by a re-equilibration of the spool position within the compensator.

Figure 9:
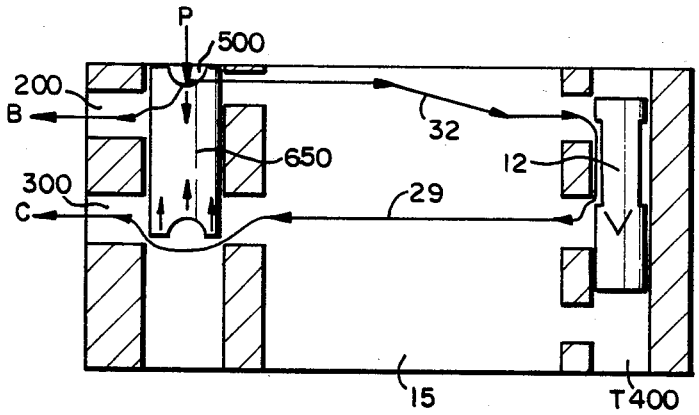

Referring now to FIG. 9, the controller 700 is shown in its fully open position. Again, the compensator spool 650 attains an equilibrium position in response to pressure and volume flow changes so as to provide constant control flow volume by metering bypass flow.

Figure 10:
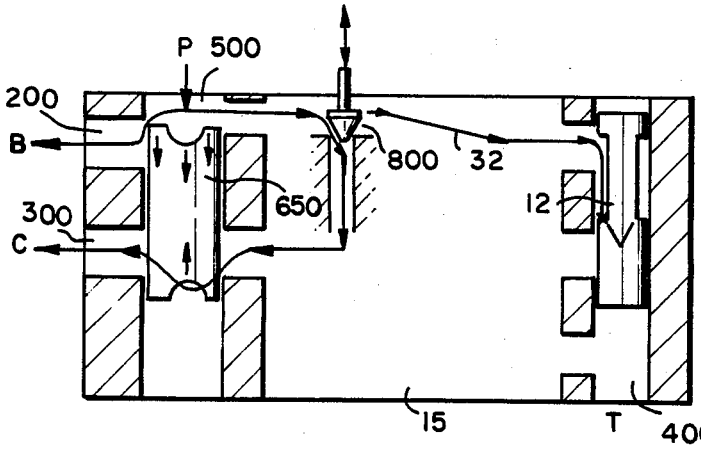

FIG. 10 details the operation of the valve assembly of the present invention when a manually operated control valve is installed. The manually operated control valve 800 provides a variable orifice permitting fluid flow between the inlet of the controller valve and the outlet passage of the controller. When opened, the manual control valve provides a constant flow rate proportional to its orifice size through the controlled flow port 800. As shown in FIG. 10, this flow is the only control flow due to the controller spool 12 being in the closed position.

Figure 11:
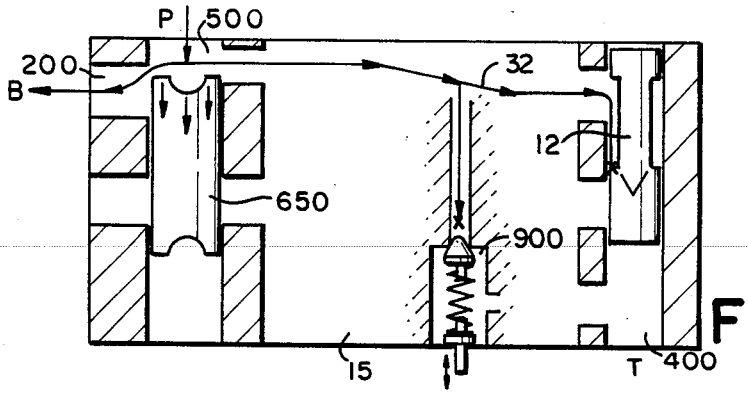

Referring now to FIG. 11, there is shown an enhancement to the valve assembly of the present invention comprising a pressure relief check valve 900. As shown, the valve assembly is operated as an open center valve. Pressure build-up which does not exceed the pressure necessary to open the relief check valve flows via the compensator to bypass flow port 200.

Figure 12:
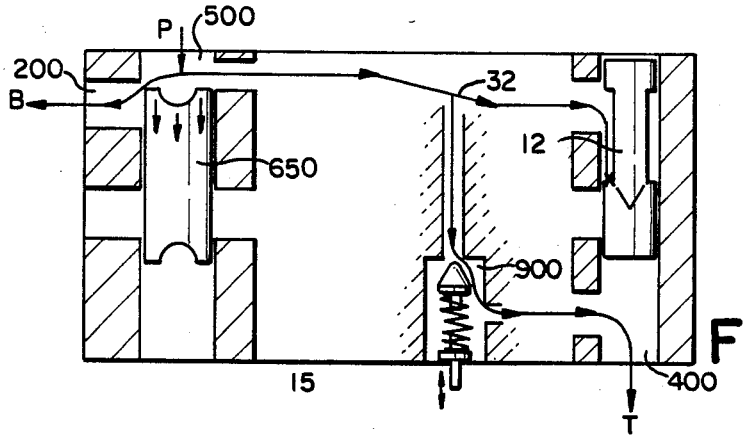

FIG. 12 details the operation of the present valve assembly when pressure within the valve exceeds that required to actuate the relief check valve 900. Flow within the valve is diverted across the check valve orifice to tank 400.

Figure 13:
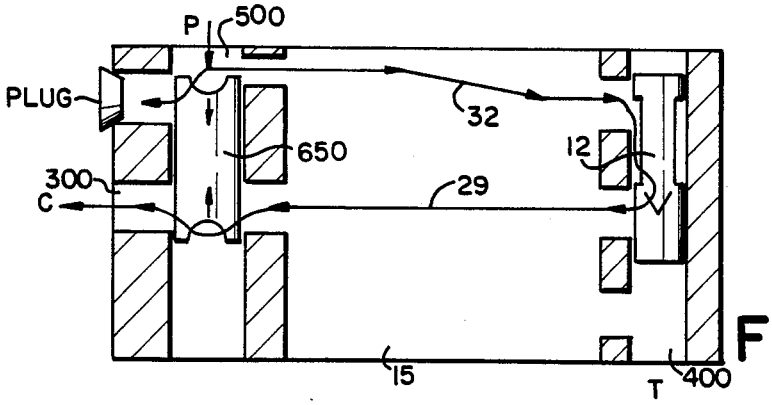

FIG. 13 illustrates the operation of the valve assembly of the present invention as a closed center valve. It will be appreciated by those skilled in the art that any of the foregoing modes of operation may be analogously carried out as closed center operations by the insertion of a plug or similar flow restriction in the bypass port. When operated as a closed center valve assembly, the compensator spool 650 continues to regulate flow through the control flow port 300 by attaining an equilibrium position to meter that flow.

Figure 14:
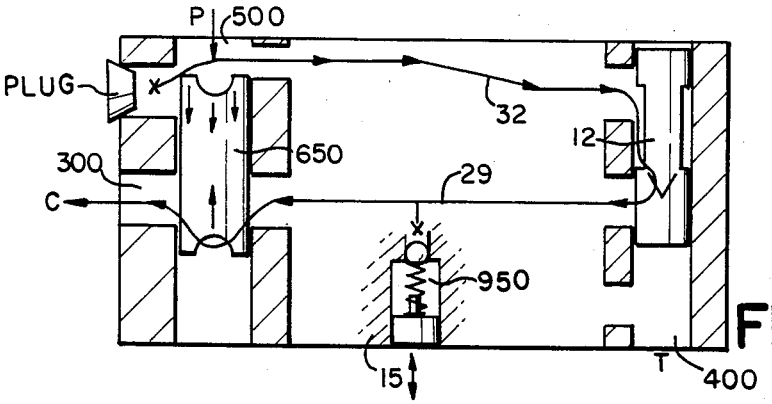

FIG. 14 illustrates the operation of the valve assembly of the present invention as a closed center valve having a pressure or load sense valve. Load may be sensed as a function of pressure of fluid in line 29 by a suitable ball check valve feeding a load sense port. Known load sense apparatus may be connected to the load sense port for operation in this mode.

Enhancements to the present valve as detailed in FIGS. 7 through 14, including manual control valves, load sense valves, and relief check valves, may be provided for operation in the closed center mode. In particular, the relief check valve detailed in FIGS. 11 and 12 may be particularly desireable when operating the present valve assembly in a closed center mode.

What is claimed is:

1. A valve assembly for speed control comprising a proportional control valve and a compensator valve, and having an inlet port, an outlet port, a tank port and a bypass port;

said compensator having a spool with upper and lower metering edges disposed in upper and lower compensator chambers, respectively;

said proportional control valve having control inlet, and control outlet ports; said proportional control valve has a valve open and a valve closed position, means for fluidly coupling the tank port to the control outlet port when the proportional control valve is in the valve closed position;

said upper compensator chamber being in direct fluid communication with the assembly inlet port, the control inlet port, and the bypass port, said upper metering edge movably disposed within said upper compensator chamber to meter fluid flow between said assembly inlet port and said bypass port. said assembly inlet port being in close physical proximity with said bypass port and in direct fluid communication therewith free of any valving restrictions other than said upper metering edge;

said lower compensator chamber being in direct fluid communication with the control outlet port and with the assembly outlet port, said lower metering edge movably disposed within said lower compensator chamber to meter fluid flow between said control outlet port and said assembly outlet port whereby the position of said compensator spool changes in response to the difference of fluid pressures between said upper and lower compensator chambers thereby providing a constant feedback loop from said assembly outlet port to said assembly inlet port maintaining a substantially constant pressure drop across the valve assembly.

2. The valve assembly of claim 1 wherein there is provided means for preventing flow through the assembly bypass port, thereby to convert the normally open-center valve to a closed-center mode of operation in which the feedback loop is maintained from assembly outlet port to assembly inlet port for a substantially constant pressure drop across the valve assembly.

3. The valve assembly of claim 2 wherein the proportional control valve is of the servo-follower type.

4. The valve assembly of claim 1 or claim 2 or claim 3 further comprising a manually operable control valve for permitting fluid flow from the assembly inlet port to the assembly outlet port regardless of the flow through the proportional control valve.

5. The valve assembly of claim 1 or claim 2 or claim 3 further comprising a manually adjustable pressure relief valve for permitting pressures which exceed a desired level to be directed to tank.

6. The valve assembly of claim 1 or claim 2 or claim 3 further comprising a load sense valve for permitting pressure within the assembly outlet port to be externally measured or monitored.

7. The valve assembly of claim 3 wherein said controller valve comprises:

a positional controller;

a main spool having an inner passage;

first fluid connections controlled by said main spool and effective to control the output fluid flow in accordance with the position of the main spool;

a pilot spool slidable in said passage;

means to move the pilot spool from a null position with the main spool in either a first or second direction in accordance with the positional controller;

a first and second driving chamber formed by the main spool each having a driving area substantially less than the largest solid cross sectional area of the main spool; and second fluid connections controlled by the pilot spool admitting fluid under pressure (1) to the first chamber when the pilot spool moves in the first direction away from said chamber and (2) to the second chamber when the pilot spool moves in the second direction away from said chamber, thereby to move the main spool in the same direction as the pilot spool until a main null position is reached.

8. The valve assembly of claim 7 further comprising third fluid connections for providing return pressure for said second fluid connections, said third fluid connections comprising bleed grooves formed at opposite ends of said main spool inner passage.

* * * * *